US006189289B1

(12) United States Patent
Quaglia et al.

(10) Patent No.: US 6,189,289 B1
(45) Date of Patent: Feb. 20, 2001

(54) TILE FLOORING

(75) Inventors: Natale Quaglia; Enrico Morettin, both of Milan (IT)

(73) Assignee: PMF Lavorazioni Metalliche S.r.l., Milan (IT)

( * ) Notice: Under 35 U.S.C. 154(b), the term of this patent shall be extended for 0 days.

(21) Appl. No.: 09/297,281

(22) PCT Filed: Oct. 30, 1997

(86) PCT No.: PCT/EP97/06005

§ 371 Date: Jun. 30, 1999

§ 102(e) Date: Jun. 30, 1999

(87) PCT Pub. No.: WO98/20212

PCT Pub. Date: May 14, 1998

(30) Foreign Application Priority Data

Nov. 7, 1996 (IT) ..... MI96A02315

(51) Int. Cl.[7] ..... E04B 5/00

(52) U.S. Cl. ..... 52/764; 52/126.7; 52/126.4; 52/263; 52/282.2; 52/582.1; 52/281; 52/220.1

(58) Field of Search ..... 52/764, 126.6, 52/126.7, 284, 585.1, 582.1, 263, 126.5, 127.8, 281, 282.2, 220.1, 479, 765, 771, 282.4, 126.4

(56) References Cited

U.S. PATENT DOCUMENTS

| | | | | |
|---|---|---|---|---|
| 3,025,934 | * | 3/1962 | Spiselman et al. | 52/126.6 |
| 3,899,857 | * | 8/1975 | Mochizuki | 52/126.6 |
| 3,927,500 | * | 12/1975 | Plumlee | 52/460 |
| 4,085,557 | * | 4/1978 | Tharp | 52/263 |
| 4,277,923 | * | 7/1981 | Rebentisch et al. | 52/126.6 |
| 4,736,555 | * | 4/1988 | Nagare et al. | 52/126.6 |
| 4,744,194 | * | 5/1988 | Yasuyoshi | 52/747.11 |
| 4,850,163 | | 7/1989 | Kobayashi et al. . | |
| 4,922,670 | * | 5/1990 | Naka et al. | 52/126.6 |
| 5,048,242 | * | 9/1991 | Cline | 52/126.6 |

FOREIGN PATENT DOCUMENTS

| | | |
|---|---|---|
| 2225892 | 12/1973 | (DE) . |
| 0488312 | 6/1992 | (EP) . |
| 2130615 | 6/1984 | (GB) . |
| 2261003 | 5/1993 | (GB) . |
| 9201130 | 1/1992 | (WO) . |

* cited by examiner

*Primary Examiner*—Carl D. Friedman
*Assistant Examiner*—Jennifer I. Thissell
(74) *Attorney, Agent, or Firm*—Sofer & Haroun, LLP

(57) ABSTRACT

A flooring which can be locally removed and relaid rapidly any number of times, comprising a plurality of tiles (2), a plurality of plate-shaped supports (5) arranged quincuncially below the tiles (2), and means of fixing the tiles to the plate-shaped supports (5).

18 Claims, 5 Drawing Sheets

TILE FLOORING

DESCRIPTION

The present invention relates in general terms to a flooring and more specifically to a flooring according to the preamble of claim 7 (see DE-A-2 225 892).

According to the state of the art, tiles are laid side by side until the entire surface to be floored is covered. The flooring thus obtained, which is advantageous from various points of view, has a disadvantage, however, which is revealed when it has to be removed in part, for example in order to gain access to cables, pipes and the like, which were laid at the same time as the flooring, or in order to lay these subsequently. The disadvantage is that removal of the tiles is laborious and inevitably involves the destruction of many if not all the tiles to be removed, with the consequent necessity of replacing them.

The problem underlying the present invention is to devise a flooring of the type indicated, which has structural and functional characteristics which make it possible to overcome the abovementioned disadvantage.

This problem is solved by a flooring according to claim 7.

Figure 1:
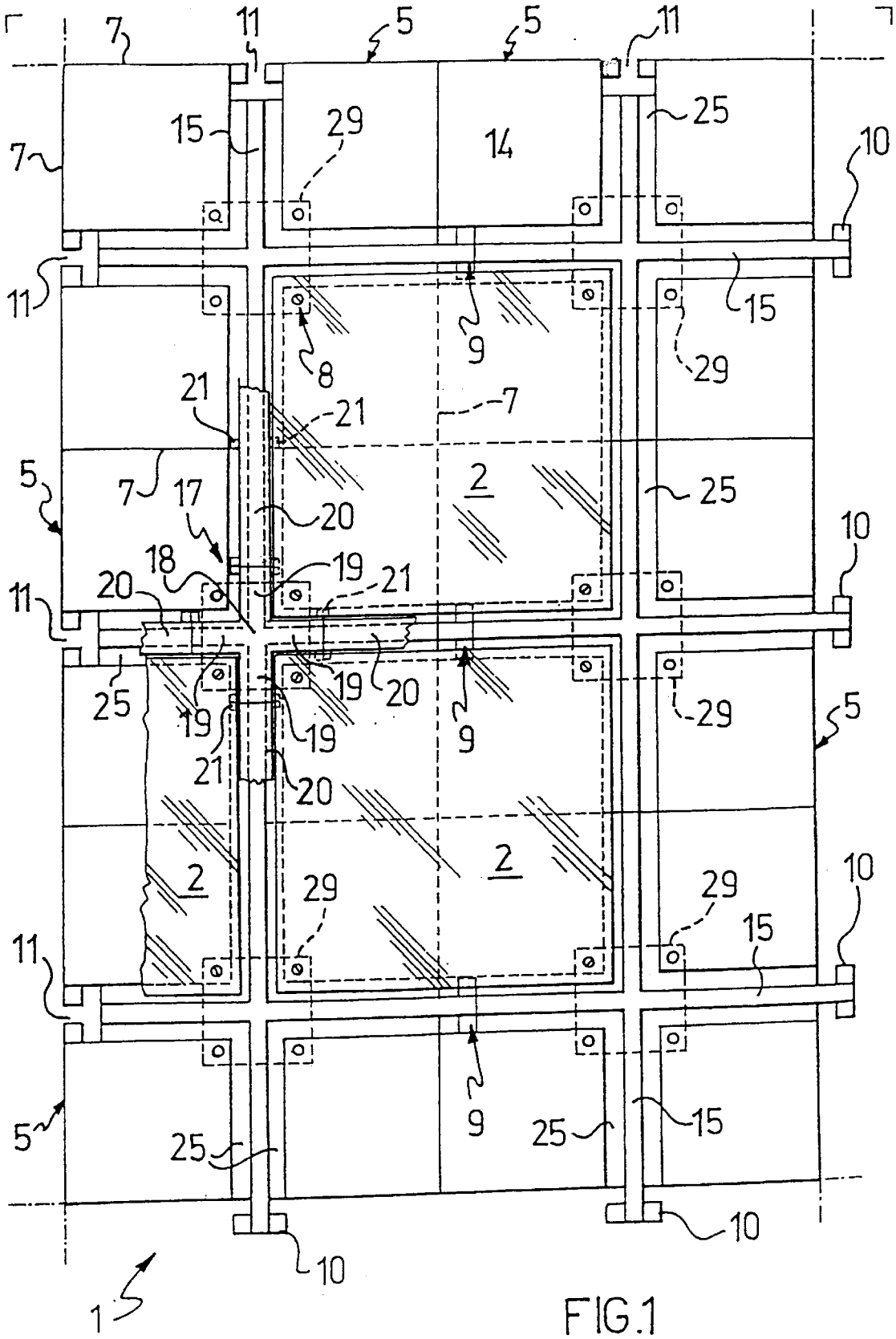
Figure 2:
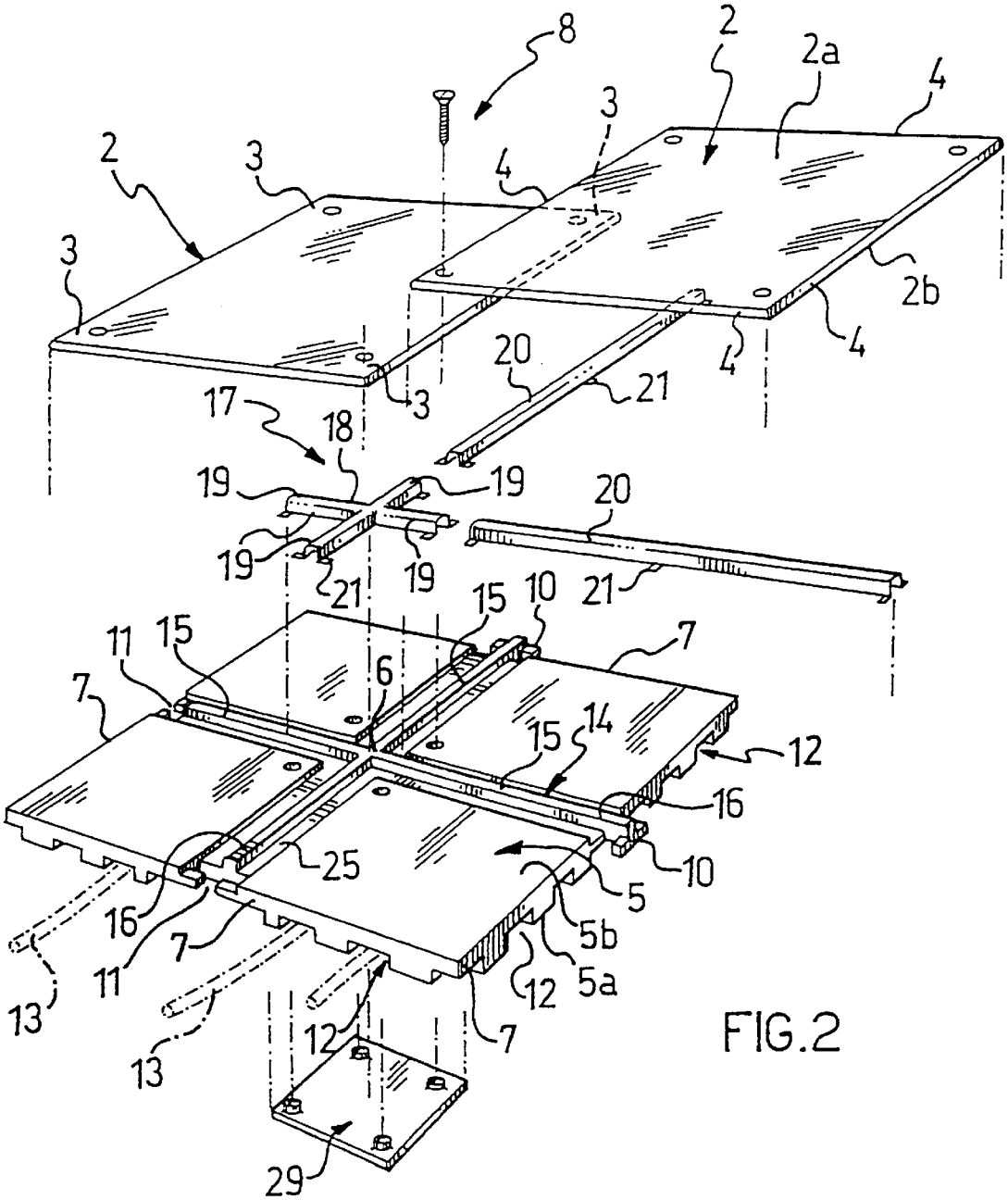
Figure 3:
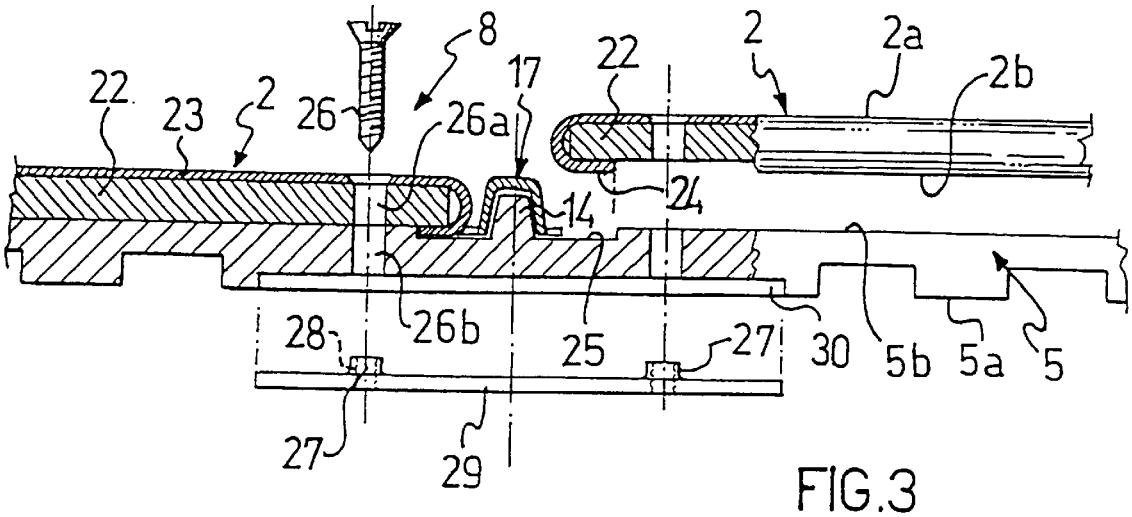
Figure 8:
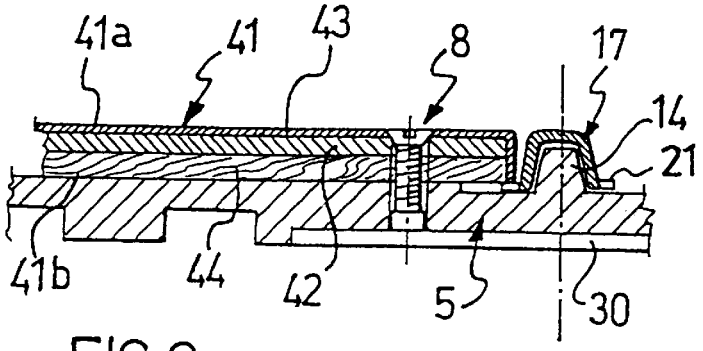
Figure 9:
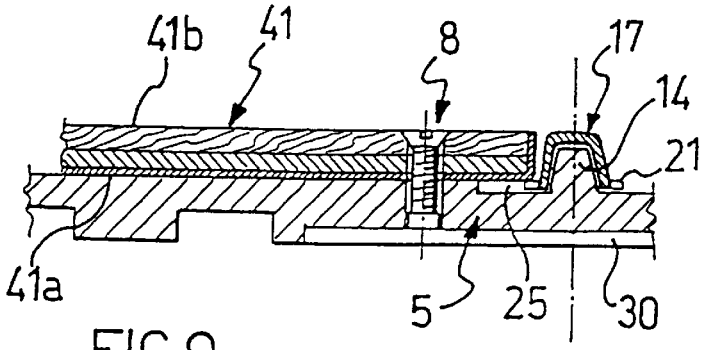
Figure 4:
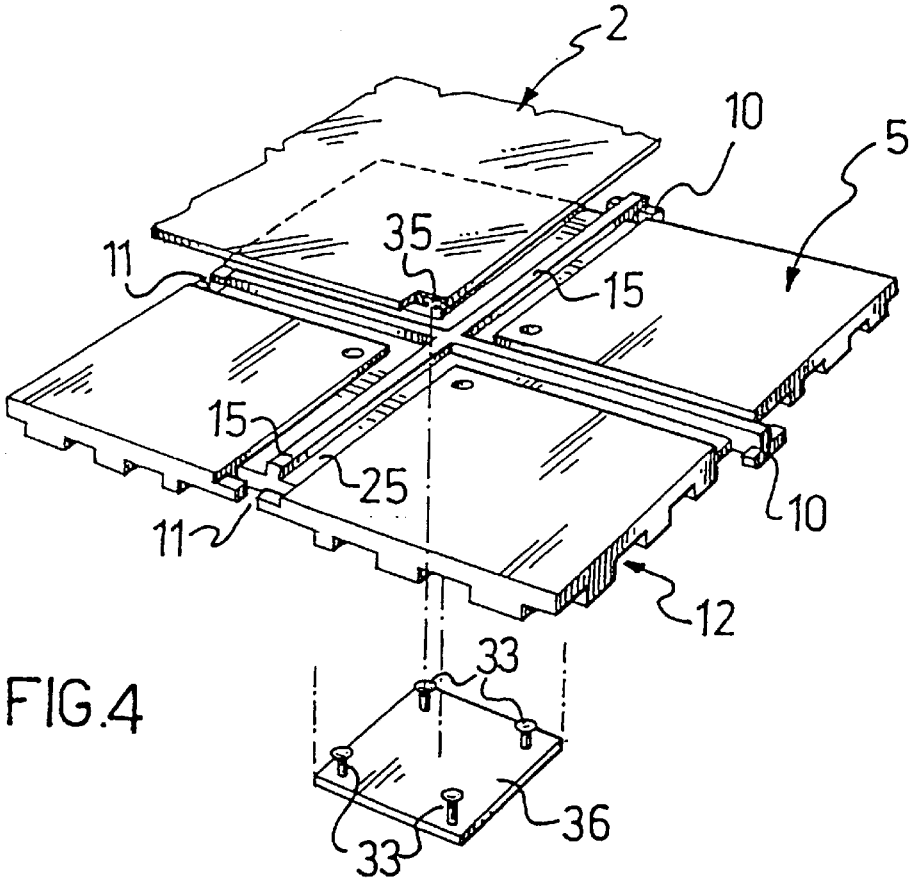
Figure 5:
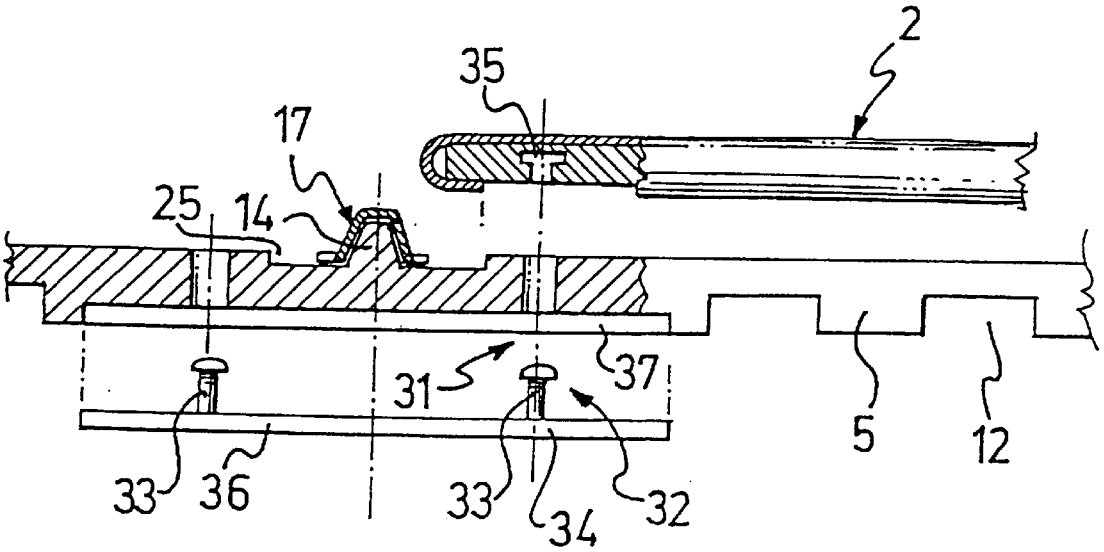
Figure 6:
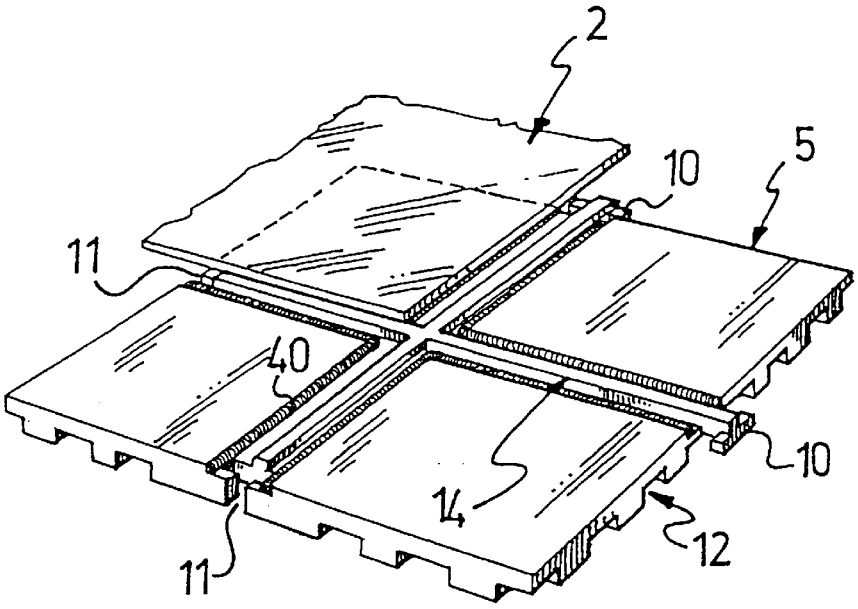
Figure 7:
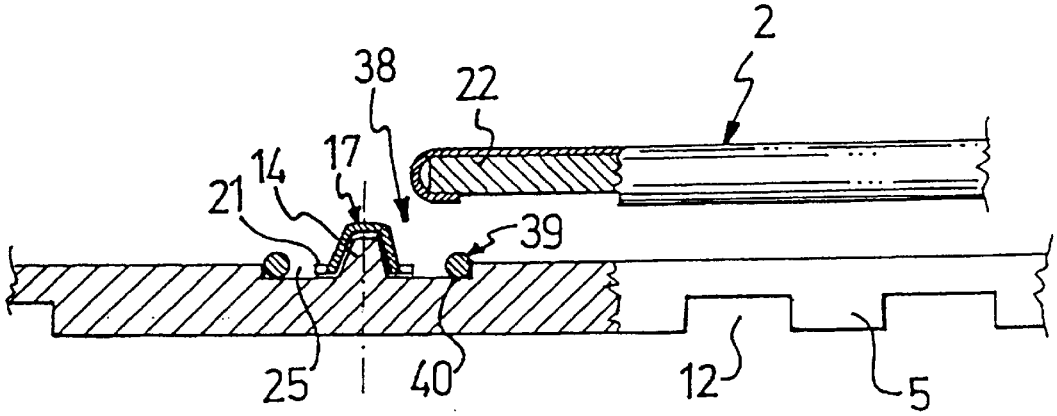

Further characteristics and the advantages of the flooring according to the present invention will emerge from the description which follows of a preferred embodiment thereof, which is given by way of non-limiting example with reference to the attached figures, in which:

FIG. 1 shows a diagrammatic plan view of a flooring according to the invention, FIG. 2 shows a perspective view with parts removed of a detail of the flooring in FIG. 1, FIG. 3 shows a view in partial section with parts removed of a detail of the flooring in FIG. 1, FIG. 4 shows a perspective view with parts removed of a flooring according to the invention, in accordance with a variant embodiment thereof, FIG. 5 shows a view in partial section with parts removed of a detail of the flooring in FIG. 4, FIG. 6 shows a perspective view of a detail of a flooring according to the invention, in accordance with a further variant embodiment thereof, FIG. 7 shows a view in partial section with parts removed of a detail of the flooring in FIG. 6, FIG. 8 shows a view in section of a detail of a flooring according to the invention, in accordance with a further variant embodiment, and FIG. 9 shows a view in section of a detail of the flooring in FIG. 8, in another functional state.

With reference to the attached figures, reference number 1 generally indicates a flooring according to the present invention.

The flooring 1 comprises a plurality of tiles, all indicated by 2, which are square in the example and arranged regularly essentially side by side in rows at right angles. Each tile 2 has four corners 3 and four sides 4.

The flooring 1 also comprises a plurality of plate-shaped supports, all indicated by 5, which are square in the example. Each plate-shaped support 5 has a centre 6 and four sides 7.

The plate-shaped supports 5 are arranged below the tiles 2 in a regular manner and essentially quincuncially in relation to the plurality of tiles in such a manner that the centre 6 of each plate-shaped support 5 is situated below the corners 3 of four adjacent tiles 2.

In the example, the plate-shaped supports are made by moulding an appropriate elastomer, for example rubber.

Fixing means 8, which will be described below, are provided for fixing the tiles 2 to the plate-shaped supports 5 in a removable manner.

The plate-shaped supports 5 are side by side in mutual contact side to side. In the sides in mutual contact, a joint 9 is provided, which stably retains the adjacent plate-shaped supports in relation to one another. The joint 9 comprises a hammer-shaped projection 10, which is formed halfway along a side 7 of a plate-shaped support, and a hammer-shaped recess 11 which mates with the projection 10 and is formed halfway along a side 7 of the adjacent plate-shaped support.

Each plate-shaped support 5 has projections and recesses in equal number, and specifically two projections and two recesses, one on each side, so that all the plate-shaped supports are identical with one another.

On its lower surface 5*a,* each plate-shaped support 5 has a plurality of channels 12 distributed in two groups of channels which are parallel to the sides and intersect one another at right angles and are advantageously dimensioned for the passage of cables, pipes and the like, which are indicated diagrammatically by 13.

On its upper surface 5*b,* each plate-shaped support has a raised portion 14 shaped like a Greek cross with arms 15 converging into the centre 6 which have an essentially rectangular section.

The raised portion 14 constitutes a filler or a bead between adjacent tiles.

The raised portion 14 of each plate-shaped support is preferably in mutual contact with the raised portions of the adjacent plate-shaped supports. That is to say the arms 15 have free ends 16, opposite the centre 6, which touch with their tip the free ends of the arms of the adjacent plate-shaped support.

A covering generally indicated by 17 is fitted onto the raised portion 14. Preferably made from a sheet of metal material, for example brass, of fine thickness, it has an upturned U-shaped section and takes the form of a cross 18, which has arms 19 of short length and covers the raised portion 14 in its zone positioned in the centre 6, and of four strips 20 which are each of sufficient length that they extend between the arms 20 of adjacent crosses, tip to tip with the ends of the arms 19 of the crosses 18. Reference number 21 indicates feet which project in a cantilevered manner from the arms and from the strips, rest on the plate-shaped support and are surmounted by the tiles.

The tiles 2 have a reinforcing core 22 which takes the form of a plate made of a ferrous material, for example common steel, and have on an upper surface 2*a* a covering 23 which takes the form of a sheet of a valuable material, for example a sheet of stainless steel, turned down over the reinforcing core, forming an edge 24 which surrounds the reinforcing core along its periphery on a lower face 2*b* of the tile.

The tile 2 rests with its lower surface 2*b* on the upper face 5*b* of four adjacent plate-shaped supports 5 which are situated below the tile 2.

The edge 24 rests in a rabbet 25 formed in the plate-shaped supports along the arms 15 of the raised portions.

The fixing means 8 comprise a screw 26 which extends between each corner 3 of the four corners of respective adjacent tiles 2, which are situated above a plate-shaped support, and the plate-shaped support itself, said screw extending through holes 26*a* and 26*b* formed in the tile and in the plate-shaped support respectively.

The fixing means 8 preferably comprise a metal insert 27 which is associated with the plate-shaped support and is equipped with a thread 28 engaged in a screwing manner by the screw 26.

In the example, the inserts 27, in which the screws 26 of the four corners are in screwing engagement, in other words the inserts of each plate-shaped support, constitute a single piece in the form of a square metal plate 29 accommodated in a recess 30 formed in the lower face 5*a* of the plate-shaped support.

A variant embodiment of the invention is described with reference to FIGS. 4 and 5, in which the elements which remain the same have kept the same reference numbers.

The flooring 1 comprises fixing means 31 formed by a press-button 32 which extends between each corner of the four corners of adjacent tiles which are situated above a plate-shaped support.

The press-button comprises a mushroom-shaped element 33, which projects from a base 34 associated with the plate-shaped support, and a seat 35 formed in the tile. Advantageously, the bases of each plate-shaped support constitute a single piece in the form of a square metal plate 36 accommodated in a recess 37 formed in the plate-shaped support.

A further variant embodiment of the invention is described with reference to FIGS. 6 and 7, in which the elements which remain the same have kept the same reference numbers.

The flooring 1 comprises fixing means 38 constituted by an adhesive element 39 which takes the form of a cord of self-adhesive material 40 which is accommodated in the region of the arms of the Greek cross-like raised portion.

A further variant embodiment of the invention is described with reference to FIGS. 8 and 9, in which the elements which remain the same functionally and structurally have kept the same reference numbers. The flooring 1 comprises tiles 41, each of which comprises a reinforcing core 42 and, on the opposite faces 41*a* and 41*b*, a first covering 43 and a second covering 44 respectively.

The first covering 43 takes the form of a sheet of stainless steel while a material with low thermal conductivity is selected for the second covering. In the example, the second covering is a sheet of valuable wood.

Each tile 41 is provided with screw fixing means and can be fixed to the plate-shaped supports by one or the other of the two faces 41*a* and 41*b* alternatively.

In use, when it is necessary to gain access to cables already laid or to run cables, it is necessary only to remove two rows of adjacent tiles in order to gain access to one row of plate-shaped supports which can in turn be removed.

By reversing this procedure, the flooring can be relaid again completely.

It should be noted that with every change of season it is possible to turn the tiles over simply by unscrewing and screwing in again the screws of the fixing means so as to expose the more suitable covering.

The main advantage of the flooring according to the present invention lies in the fact that it lends itself to being rapidly removed locally as required and to being completely reinstated again using the same tiles which have been removed any number of times so as always to assume the identical appearance again.

A further advantage of the flooring according to the present invention lies in the fact that it can be laid rapidly.

A further advantage lies in the fact that it has great resistance to penetration of water, during cleaning, thanks to the presence of the cross-like raised portions provided in the plate-shaped supports.

A further advantage of the flooring according to the invention rests in the fact that it lends itself to being made so as to achieve an aesthetic quality also thanks to appropriate selection of materials for the tiles and the coverings of the raised portions.

The flooring according to the invention also lends itself to being adapted to different climatic conditions, for example to winter and to summer, by laying the tiles with whichever of the two coverings is indicated from case to case.

The flooring according to the invention is also structurally simple and robust which is an advantage in particular for a manufacture which is intended to have a long service life. The fixing means not only secure the tiles firmly to the plate-shaped supports but also secure the tiles firmly in relation to one another by means of the plate-shaped supports, rendering the flooring a whole.

It is also favourable from the environmental point of view and in particular is effective in overcoming noise pollution thanks to its good capacity for deadening impacts, vibrations and noise, both airborne and from footsteps.

The flooring according to the invention also lends itself to being made with tiles of various shapes.

It is also possible to replace a single tile rapidly, for example if damaged.

Clearly, for the purposes of meeting contingent and specific requirements, an expert in the field will be able to make numerous modifications and variations to the flooring described above, all nevertheless contained within the scope of protection of the invention as defined by the claims below.

What is claimed is:

1. Flooring comprising:

a plurality of tiles;

a plurality of plate-shaped supports arranged below corners of adjacent tiles wherein said plate-shaped supports are displaced with respect to said tiles so that each of said plate-shaped supports supports a corner of each of four adjacent tiles and wherein said plate-shaped supports have dimensions substantially equal to the dimensions of the tile; and a fixing means for the removable fixing of the tiles to the plate-shaped supports, wherein the fixing means comprise a screw and a metal plate, said screw extending from the top of each corner of the tile to said metal plate through said plate-shaped support, said metal plate having threaded holes in which each of said screws engages.

2. Flooring according to claim 1, characterized in that each plate-shaped support comprises a raised portion constituting a filler between adjacent tiles.

3. Flooring according to claim 2, and in which the tiles are square, characterized in that the raised portion is cross-shaped.

4. Flooring according to claim 3, characterized in that the plate-shaped supports are square and are in mutual contact.

5. Flooring according to claim 4, characterized in that the raised portion of each plate-shaped support is in mutual contact with the raised portions of adjacent plate-shaped supports.

6. Flooring according to claim 5, comprising a covering for the cross-shaped raised portion, formed by a cross having arms of short length and by strips extending between the arms of adjacent crosses.

7. Flooring according to claim 6, characterized in that the arms and the strips have an upturned U-shaped section and are equipped with feet projecting in a cantilevered manner.

8. Flooring according to claim 1, characterized in that it comprises a joint between adjacent plate-shaped supports.

9. Flooring according to claim 8, characterized in that the joint comprises, formed respectively on facing sides of adjacent plate-shaped supports, a hammer-shaped projection and a hammer-shaped seat which mates with the projection.

10. Flooring according to claim 9, characterized in that each plate-shaped support has projections and recesses in equal number.

11. Flooring according to claim 1, characterized in that each plate-shaped support comprises at least one channel formed in its lower surface.

12. Flooring according to claim 1, wherein each tile comprises a reinforcing core and a covering which has an edge turned down over the core.

13. Flooring according to claim 12, wherein each plate-shaped support comprises a rabbet which is dimensioned to accommodate the edge of the covering of the tile which is turned over the core of the tile.

14. Flooring according to claim 13, characterized in that the covering is a sheet made of stainless steel.

15. Flooring according to claim 14, characterized in that the tile comprises a second covering associated with the reinforcing core on the opposite side from the covering made of stainless steel sheet, a material with low thermal conductivity being selected for said second covering.

16. Flooring according to claim 15, characterized in that the second covering is a sheet of wood.

17. Flooring according to claim 1, wherein said tile has a total surface area and said corner of each of said four adjacent tiles has an area that is approximately one-quarter of said total surface area.

18. Flooring according to claim 1, wherein four of said plate-shaped supports are configurable to substantially cover and support said total surface area of said tile.

* * * * *